United States Patent [19]

Taft et al.

[11] Patent Number: 4,736,952

[45] Date of Patent: Apr. 12, 1988

[54] GOLF TRAINING AND PRACTICE DEVICE

[75] Inventors: Carlton R. Taft, Orange, Calif.; Derek J. Hardy, 2026 N. Williams, Santa Ana, Calif. 92701

[73] Assignee: Derek Hardy, Santa Ana, Calif.

[21] Appl. No.: 872,203

[22] Filed: Jun. 9, 1986

[51] Int. Cl.[4] ..... A63B 69/36

[52] U.S. Cl. ..... 273/183 E; 273/186 R; 273/187 R

[58] Field of Search ..... 273/187 R, 187 A, 183 A, 273/195 R, 186 R, 186 C, 183 E

[56] References Cited

U.S. PATENT DOCUMENTS

| | | | |
|---|---|---|---|
| 1,517,555 | 12/1924 | Graham | 273/187 R |
| 2,150,580 | 3/1939 | Crowley | 273/187 R |
| 3,166,327 | 1/1965 | Champion | 273/187 R |
| 3,868,116 | 2/1975 | Ford et al. | 273/187 R |
| 4,384,718 | 5/1983 | Cachola | 273/187 R |
| 4,544,160 | 10/1985 | Miner | 273/187 R |
| 4,563,010 | 1/1986 | McDorman et al. | 273/187 R |

FOREIGN PATENT DOCUMENTS

| | | | |
|---|---|---|---|
| 17666 | of 1915 | United Kingdom | 273/187 R |

*Primary Examiner*—George J. Marlo
*Attorney, Agent, or Firm*—Jackson & Jones

[57] ABSTRACT

A highly versatile right or left-handed golf training and practice device is disclosed. The basic device includes three flat thin guide pieces pivotably joined together in the shape of a reverse-U and placed on the ground in front of a user with an open end thereof as a swing follow-through for the user. Color-coded indicia on the three guides assist in body, ball and stance positioning. Attachments include club head alignment faceplates, a clubhead sweep bar, body turn and shoulder positioning guide posts.

10 Claims, 2 Drawing Sheets

GOLF TRAINING AND PRACTICE DEVICE

BACKGROUND OF THE INVENTION

1. Origin of the Invention

This invention is the result of a golf instructor, and student's co-recognition of a long unsolved problem and means for solving same.

2. Field of the Invention

The field of this invention involves an apparatus for enhancing the training and perfection of an individual's golf game. More particularly, the apparatus is portable and highly versatile. A user can train and practice the user's golf swing with all clubs from putter to driver. The device readily aids improvement of the many diverse areas of a user's golf swing.

3. Description of the Prior Art

A prior art search revealed a number of patents which do not teach or suggest the novel features of this invention. These prior art patents reveal that devices for guiding a golf swing by positioning the ball and the user's feet to suit the different swing requirements for different golf clubs are well known, as are open-ended tracks for assistance in training a putting stroke. The patents located in the search include the following:

| Patent No. | Issue Date | Issued to |
|---|---|---|
| 2,150,580 | 03/14/39 | CROWLEY |
| 3,343,268 | 09/26/67 | SCHENNYM |
| 3,459,429 | 08/05/69 | GREEN |
| 3,860,247 | 01/14/75 | TAYLOR |
| 4,146,231 | 03/27/79 | MERKLE ET AL |
| 4,257,608 | 03/24/81 | FUNK |
| 4,384,718 | 05/24/83 | CACHOLA |
| 4,538,815 | 09/03/85 | POIRIER |
| 4,544,160 | 10/01/85 | MINER |

The patents to Taylor and Miner are directed solely to putting practice, and do not accommodate all of the clubs a golfer requires for a full game.

The Crowley, Green, Funk, Poirier, Cachola and Schennym patents disclose devices which are mainly concerned with feet placement, and include some portion of the device which interferes with or provides the possibility of being in the way of the hit and follow-through of a golf swing. The Cochola patent includes a three-sided device with two parallel sides formed from flat elongated strips to define a stance guide strip and a line of flight guide strip. Cachola, however, joins those guide strips with a transverse strip with its longitudinal axis disposed perpendicular to the longitudinal axis of the guide strips, and in line with the designated golf ball positioning area, which is placed outside of the line of flight strip. An extensible ball position ruler located outwardly from the user at the end of the perpendicular strip is an index and gauge to touch the ball. The ball position ruler, the line of flight strip, and the perpendicular strip all have the distinct possibility of interfering with the golf swing hit point or follow-through.

The Merkle et al patent discloses a golf platform for both of the golfer's feet and for the ball. It is neither compact nor portable and does not teach or suggest the invention.

SUMMARY OF THE INVENTION

A user-selectable golf stance, swing alignment, club face position, club take-away, down-swing governor, body turn and putt training device for either right or left-handed golfers is claimed. The multi-function device of this invention comprises three elongated flat strips of material to be arranged on the ground in front of a trainee in the assembled shape of a reversed block U with a follow-through-opening relative to a ball placement position located in the interior of the enclosed part of said reverse-U. Said reverse-U is formed by a pair of parallel essentially elongated flat strips joined together by a perpendicular strip located across the parallel strips at the back-sweep side of the trainee. The inside area of the reverse-U defines a ball placement position therebetween and in front of said trainee. The most outwardly located strip relative to said trainee is a line of flight guide for the club head, and said strip closest to the trainee is a line of stance guide. When in use by a trainee, the user takes a normal golf-swing stance with a club head positioned behind the ball located in the inside area of said reverse-U shape and his feet positioned outside and essentially perpendicular to the line of stance guide.

All guides bear color-coded areas to denote the club to be used in the trainee and the foot and ball placement positions for each given club. The line of stance guide is moved closer to, or away from, the line of flight guide in accordance with like color-coded areas on the perpendicular, or base strip. Flat indicator pads, slidable along the parallel guides, are moved by the trainee to match the appropriate club then being used. A plurality of parallel lines on the upper surface of the line of flight indicator pad provide a visual reference to assure that the parallel lines found on every club face are properly positioned. A swivel connection on said indicator pad allows the pad to turn through shallow angles so that open and closed club face positions may be practiced. Attachments, in addition to the basic strips, include an arcurate-shaped swing guide, club head pick-up control arm, user's head and shoulder positioning poles and body-turning control aids.

In summary, the versatility of the training device allows a user to practice all training essentials for all clubs (putter through driver) with a light, compact and quickly assembled portable training device.

DETAILED DESCRIPTION OF THE DRAWINGS

Figure 1:
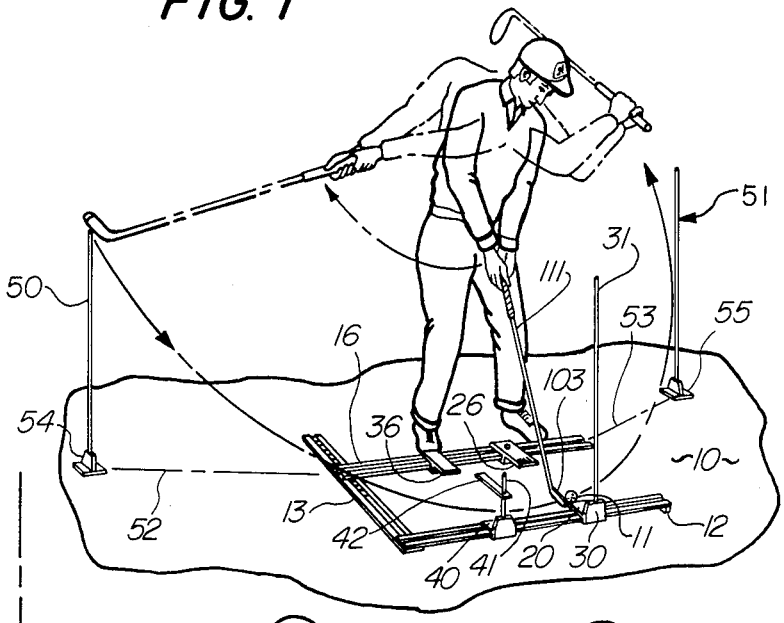
FIG. 1 is a perspective view of the golf training invention and attachments therefor.

FIG. 1 is a perspective view of the golf practice training device 10 of this invention. The device 10 of FIG. 1 includes three thin flat horizontal guides assembled into essentially a reverse-U shape when in use by a trainee. The outermost guide 12, just beyond ball 11, is a line of flight guide. At the right-most side for a right-hand golfer is a base strip 13, and at the location nearest the trainee's feet in a stance line guide 16. The open end, opposite the base line guide 13, permits an open unimpeded area for hit and practice-swing follow through.

Figure 5:
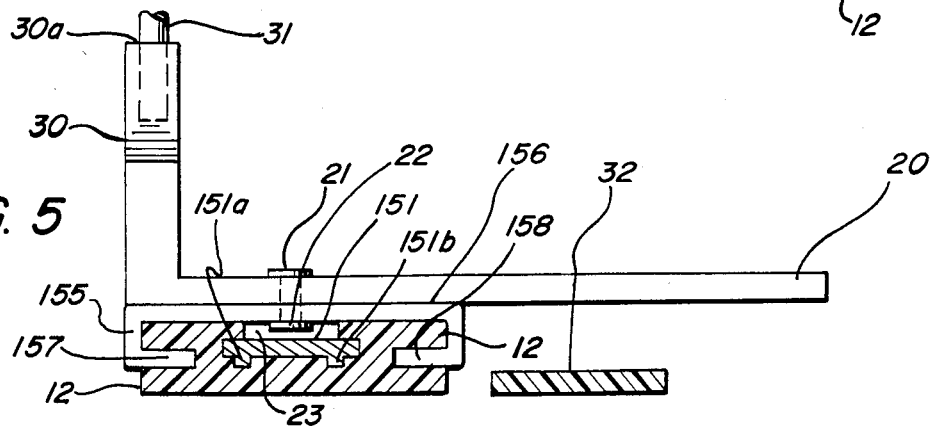
FIG. 5 is a sectional view taken along the lines 5—5 of FIG. 2.

Each guide, as shown in cross section in FIG. 5, is an I-shaped flat material selected from, for example, extruded plastic, aluminum or the like. A stiff insert 151 with a pair of downwardly descending rails 151A, 151B is located in a similarly shaped recess located in the top of the I-shaped section if it is made of extruded plastic. The stiff insert 151 may be selected, for example, from aluminum which is lightweight and yet adds stiffness and a high degree of resistance to bending or twisting of the guide material. Since the training device is exposed to the sun and heat and is also portable for storage in automobile trunks etc., a high degree of resistance to twisting is needed.

Figure 2:
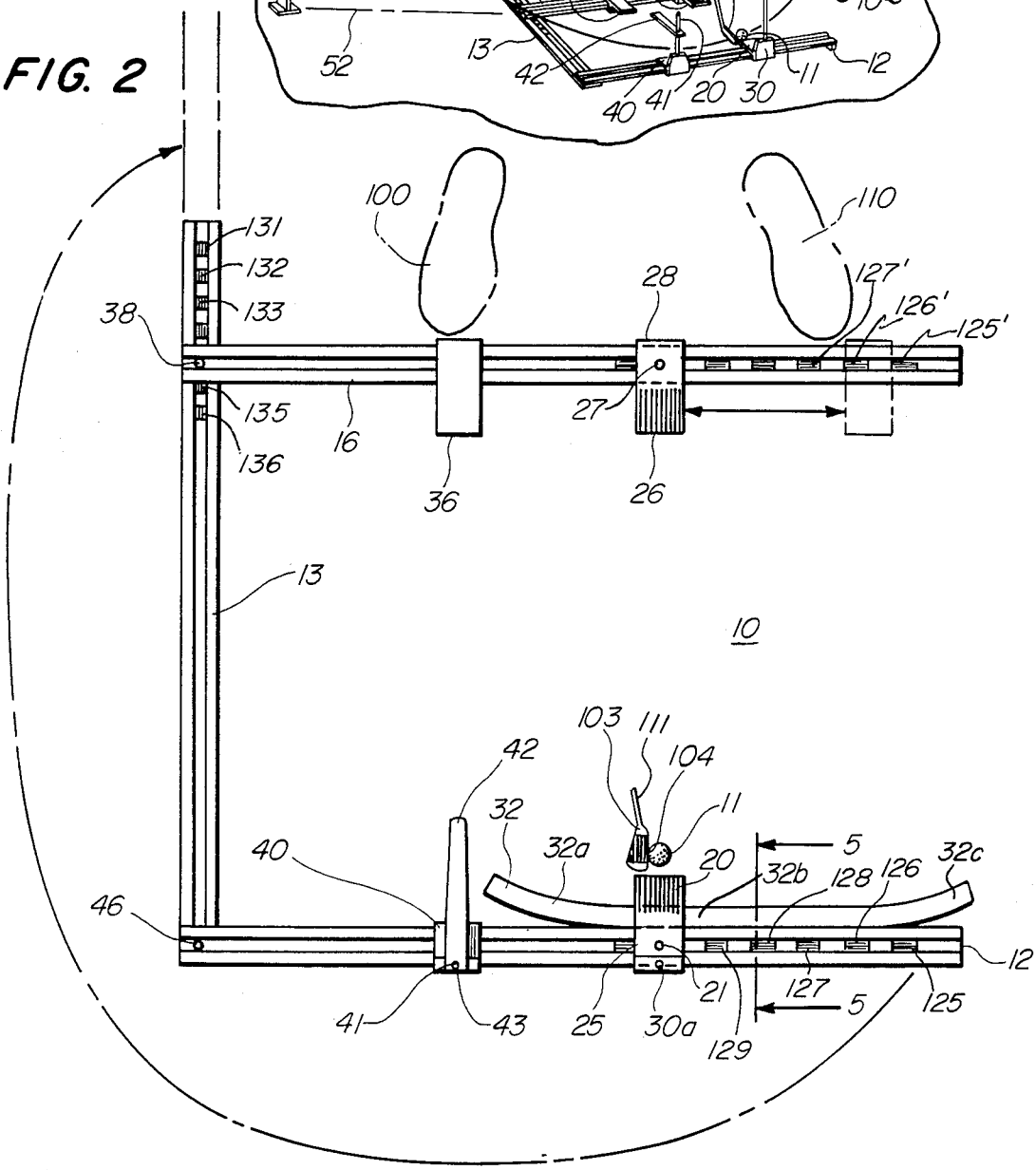
FIG. 2 is a top view looking down on the training device and showing alignment, foot and ball position.

C-shaped slides, such as slide 155 shown in FIG. 5, having flat upper surfaces such as surface 156, ride across the top of the guides 12, 13 and 16. Each slide includes inwardly extending tongues such as tongues 157 and 158 for slide 155. These tongues slidably hold the C slides so that they are free to ride in the grooves in guides 12, 13 and 16. Such C slides also hold the various faceplates of this invention to the guides 12, 13 and 16. Each cross section of the faceplates or corners is essentially the same as that depicted in FIG. 5, except that either an upper guide or a faceplate rides on a C-shaped slide. Additionally it should be noted that the screw and nut combination 21, FIG. 5, may extend all or some of the pieces to achieve the features of this invention. Thus, for example, as shown in FIG. 2, the upper right hand intersection of line of flight guide 12 with the base guide 13, is held together by screw 46 which extends through openings in all of the pieces at that corner. In the remainder of the instances the screw only goes through the upper piece and the top piece of a C slide such as slide 155. Nut 22 rides in the upper groove 23 of guide 12 as shown in FIG. 5. Screw 21 and nut 22 is spring biased by any suitable spring means (not shown).

It is known that golfers take divots of turf when striking a golf ball. Thus the "hit" area of real turf becomes temporarily damaged during practice. In the absence of the training device 10, a golfer is, of course, free to move slightly so that each practice ball is always on an undamaged piece of turf. Training device 10 is adapted so that it may readily be moved to permit a trainee to practice with his ball on an undamaged piece of turf. Thus, the connection points and fastening means 38 and 46 are suitably arranged so that the three guides 12, 13 and 16 are selectively and rigidly joined together as a unitary device. The basic training device 10, once adjusted for a given practice area, can then be moved from spot to spot on the ground without any readjustment being needed after each move.

A clubhead alignment faceplate 20 is pivotably fastened by a holddown screw 21, or the like, to a slide 25 which is normally slidably positioned on the line of flight guide 12. Faceplate 20 extends within the reverse-U boundaries formed by guides 12, 13 and 16. Screw 21 snugly holds faceplate 20 to slide 25, but is loose enough so faceplate 20 can pivot through shallow vertical angles on the top of slide 25. A right angle upwardly extending bracket 30 is formed at the outer portion of slide 25, which bracket 30 has a hole **30*a* for receiving an upright head-positioning pole 31**.

Another foot and ball position faceplate 26 is pivotably fastened by a holddown screw 27 to a second C-slide 28, which is also normally slidably positioned in the I grooves on the line of stance guide 16. A rear foot marking pad 36 is also slidably located on a C-glide riding in guide 16, which foot marking pad 36 is located between the location of faceplate 26 and the intersection of base strip 13 with stance guide 16. The three guides 12, 13 and 16 are pivotably held together by fastening means such as spring loaded screws 38, 46. Screws 38, 46, when advised by the user, permit the guides 12 and 13 to swivel about the connection points at base strip 13.

Another C-slide 40 is slipped onto the line of flight guide 12 and is positioned to the rear of the clubhead alignment faceplate 20. Slide 40 holds a vertically positioned rod 41, which has located at its upper end a horizontally positioned sweep bar 42. Bar 42 extends into the ball area over the arcuate swing path template 32. Sweep bar 42 is fitted with a slightly over-sized hole 43, which fits over the vertical rod 41 and binds to that rod in a released position. Bar 42 is thus gravity held onto rod 41 and can be manually positioned at various heights above and behind the ball by a trainee during the trainee's learning cycle.

A pair of upright poles 50, 51 are held by base plates 54, 55. Base plates 54, 55 can either be stand alone units or they may be located at the ends of extensions 52, 53 shown simply by dashed lines in FIG. 1.

In operation the reverse-U shaped unit 10 is placed flat upon the ground with the open end to the left and the base strip 13 to the right of a right-handed trainee. The user, standing outside of or below the line of stance guide 16, places his right or rear foot 100 with the toes pointing toward the foot marking pad 36. The user's left or forward foot 110 is located toward the forward end of stance guide 16. A ball 11 to be hit is placed at ball location faceplate 20. The parallel lines on faceplate 20 held align the club for the type of golf shot to be practiced. Another set of parallel lines on the foot-positioning faceplate 26 also ensure proper alignment of the clubhead relative to the ball on the user's stance.

Various factors of great importance in reliable training of a consistent golf swing will now be described under appropriate headings with respect to the various views involved.

A. Alignment

Incorrect alignment is a major problem for many golfers. Even low handicap players are vulnerable to this problem. There are two lines involved in alignment. (1) A line, called "the line of flight" which points directly to the target. (2) A line crossing the feet pointing parallel left to the target, called "the line of stance". The line of flight is the most important line.

The two lines are important as they both help the body to be aligned to the "line of flight" and the "line of stance". If the feet are on a different line than the flight line there is the tendency for the ball's path to follow the foot line. With the feet aligned parallel to guide 13 and essentially perpendicular to guide 16 and the clubhead lines also perpendicular to the line-of-flight guide 12, a straight hit is achieved. In contrast an open stance encourages the club to be swung towards the outside. Conversely, a closed stance encourages an inside swing. Both swing deviations cause a slight curve to the ball, rather than a straight flight.

As shown in FIG. 2, the trainee's rear foot 100 is pointed to the rear foot marking pad 36 on stance guide 16. The toes of the front foot 110 is away from the line of stance guide 16 the same distance as the toes of the rear foot 100. When guides 12 and 16 are parallel with one another, the training device is in proper alignment for the user to achieve a straight hit. That straight-hit position is shown in FIG. 2.

B. Face Position

In order to hit the ball 11 straight, the club face 103 of club 111 must be at right angles to the line of flight guide 12. The lines 104 of the club face 103 are cut parallel to the bottom line of the club face 103.

Training device 10 has two checkpoints for club face position. The first checkpoint is furnished by faceplate 30 on the line of flight guide 12 with black lines at right angles to the flight line. Another faceplate 26 on the stance line guide 16 has the same black lines located thereon.

In order to check that the face position is in a proper position for a straight flight for ball 11, the lines 104 on the club face 103 must point between the feet and be in line with the black lines on both faceplates 20 and 26.

C. Ball Position

The position of the ball 11 in the stance is extremely important. The driver or number 1 wood is played foremost in the stance. The fairway woods numbered 2-3-4-5 are played slightly behind the driver. The long irons 1-2-3-4 are played slightly behind the fairway woods. All other clubs 5-6-7-8, pitching wedge and sand wedge are played in the middle of the stance.

The driver, fairway woods and long irons are played with the feet at their widest stance. As the clubs get shorter (lower in number), the width of the stance get narrower.

In the training device 10, a position approximately 4 inches from the end of the line of flight and line of stance guides is color-coded by a color tab 125 for the driver. At about five inches from the ends is another distinct color at color tab 126, for the highest number fairway wood, and at about six inches from the ends is another distinct color by color tab 128, 129, etc. which is color-coded for the long irons.

As the stance narrows the ball position is in the middle of the stance. Using the slide on the stance line the trainee adjusts the slide observing the color coded tabs on the stance line. As shown, the faceplate 20 on the line of flight guide 12 is moved to the corresponding color thereby guaranteeing the correct ball position.

D. Distance From Ball

Most inexperienced golfers have problems consistently positioning the ball 11 at the correct distance from the body. If the ball 11 is too far away from the body, the upper part of the body is stretching. This stretching forces the club off the proper clubhead path line. If the ball 11 is too close to the trainee, the lower half of the body stays in the way of a proper swing and contributes to blockage of the swing. In both instances balance is considerably affected.

In the training device 10 the line of stance is adjustable relative to color-coded indicia placed on the base line 13. A player and the device 10 will initially be adjusted by an instructor (or by himself) for each club. At appropriate points a series of color-coded club tabs, 131 through 136, are placed on the base line 13. When a player wants to practice a specific club he/she adjusts the stance line to the color-coded tabs on the base strip 13. The positions of the tabs assure proper distance from the ball for the designated clubs.

E. Ball Maneuvering

In order to maneuver the ball, certain things must take place. The law of face position, however, primarily controls the curvature of the ball in its flight. If the clubhead face is straight to the path of the swing, e.g. clubhead face lines are at right angles to the line of flight 12, the ball will go straight. If the face is closed the ball will hook. If the face is open the ball will slice.

Figure 3:
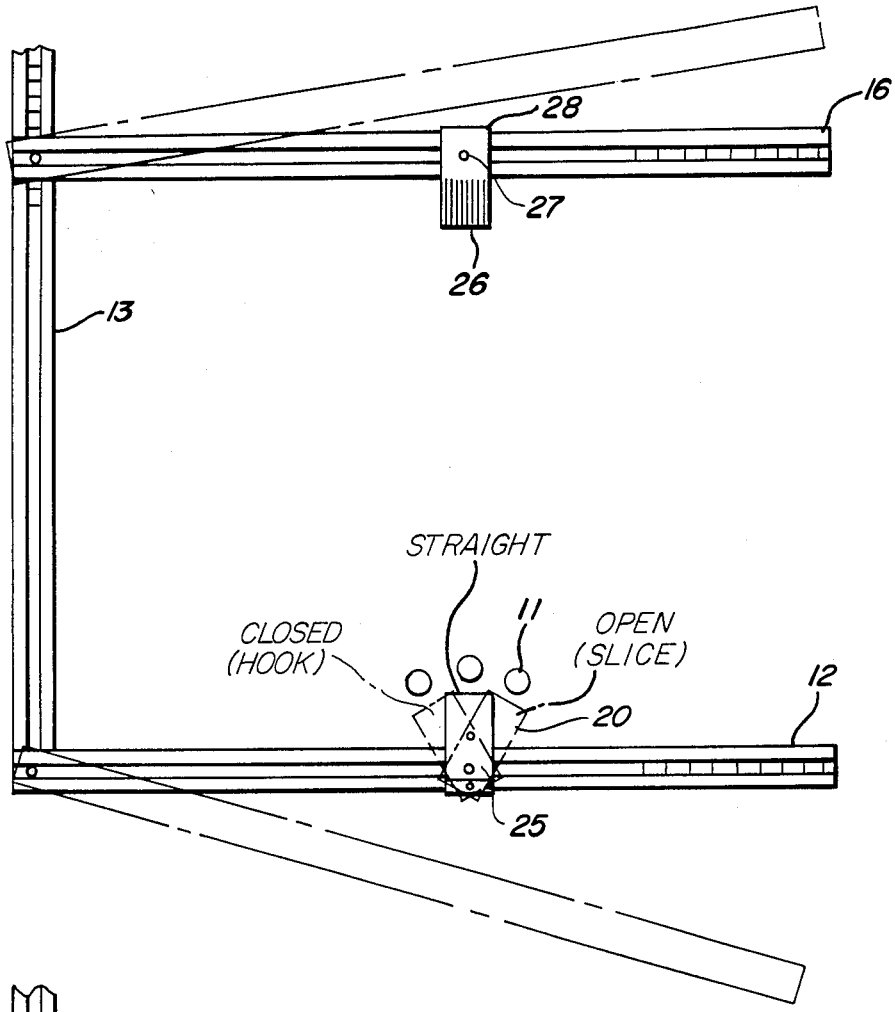
FIG. 3 is a top view, looking down, useful in depicting ball position and training for an open or a closed stance.

In the training device 10, as shown in FIG. 3, the face position slide 20 can be swiveled to the closed or open position as shown by the dashed lines. Small vertical angles on the slide 25 indicates the severity of the hook or slice to be practiced. In use, the player lines up his clubhead face lines to the slide lines 20 in a straight, hook or slice position. Swinging normally with the training device guides positioned as shown by solid lines in FIG. 3, the ball will go straight, hook or slice depending upon the position of faceplate 20.

F. Open Stance—Closed Stance—Path Line

There are times in playing golf, when an open or closed stance is desirable. For example a fade shot (the ball going slightly right and moving from left to right for a right-handed golfer) requires an open stance. A draw shot (ball going slightly left and moving from right to left for a right-handed golfer) requires a closed stance.

A shot requiring an open stance is the chip, or pitch, shot. An open stance removes the left hip from the stance line. Shortness of swing and time of swing for a chip shot are the main reasons for requiring the left hip to be moved out of the way.

In the training device 10 the stance line and the flight line may be pivoted to various angles from their straight parallel positions, as shown by the dashed positions, FIG. 3, for the flight line 12 or the stance line guide 16.

G. Chipping Device

In chipping and pitching, path becomes critical. This part of golf is the accuracy side of the game.

With the training device 10 of this invention, the line of flight and the stance line are moved closer together to form a chipping track. The stance line is then moved to the open position and a trainee swings along the path of the flight line. A player, when practicing in this mode, will be in a track and will most likely rapidly improve his chipping and pitching.

H. Putting Device

Figure 4:
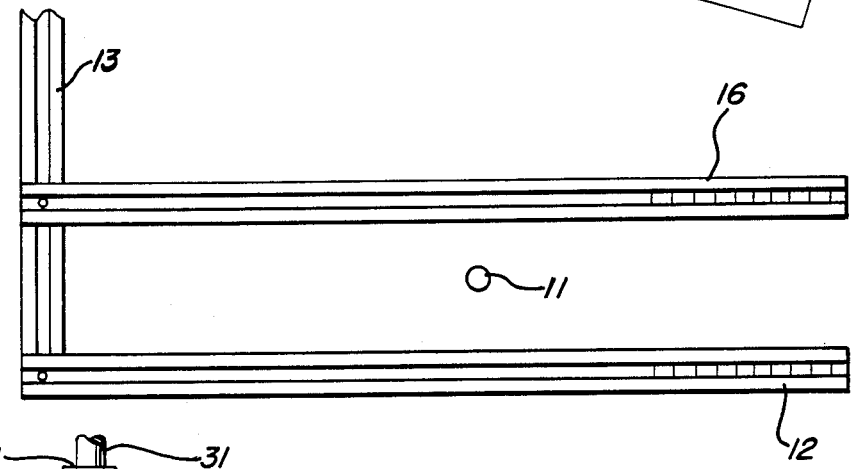
FIG. 4 is a top view looking down and depicting a putting trainer.

By moving the flight line and the stance line very close together a putting track is formed as shown in FIG. 4. All slides are removed when making the putting track. A putting track can be used on the putting green, or a short base strip attachment may be substituted for the standard base strip 13 for use in the house or office.

Practicing the putting stroke in a mechanical manner with the putting track of FIG. 4 will most likely improve putting for the trainee.

I. Swing Center and Shoulder Alignment

Since the head moves in a golf swing, the golf swing does not pivot around the head. Rather the golf swing pivots around the trainee's spine.

The training device 10 uses an upright pole attachment 31, FIG. 1, that allows the tip of pole 31 to denote the swing center. In normal swings the head may be even or slightly behind the head location line defined by the upper end of the vertical upright 31. In chipping the head is positioned ahead of the marker, creating a slight downward blow. This marker 31 allows a good weight transference and allows the player to keep a good swing center.

We have discovered that even very good golfers have a definite tendency to place the shoulders at a slight angle with respect to the flight line. Such shoulder placement is detrimental, since the shoulders should be "square" or parallel to the flight line. By placing the two upright poles 50 and 51 on the upper surface of the flight guide and on both sides of the head marker 31, a trainee has a "square" shoulder reference. Improvement can thus be expected. Although some teaching pro's use a fence or a wall to try to guide a student's shoulder alignment, the training device 10 of this invention is intended to achieve better results in a far simpler and more practical manner.

J. Clubhead Sweep

The majority of golfers have a tendency to pick the club up instead of initially sweeping the club backward away from the ball with the clubhead being kept close to the ground. The training device 10 has an attachment designed to eliminate this problem area.

A sweep slide bar 42 is attached to the flight line 12 and it is located to the right of the club face slide (for a right-handed golfer). The pick up slide 42 is positioned on vertical post 41 with the sweep bar 42 being horizontally located above the clubhead "sweep" line. The player sweeps the clubhead back close to the ground and under the bar 42 during the backswing. During the forward swing the clubhead again comes under the sweep bar 42. As the players skill develops the slide is moved further away from the club face slide to control the back and forward sweep of the club. Also, the sweep bar is moved lower and lower as a player improves this facet of his/her game.

K. Path

The path of the golf club is not straight back, nor inside out, as was popularly believed. It is inside, inside, inside.

The training device 10 has a swing template attachment 32 that shows the inside, inside, inside path of a proper swing. The golf swing actually has a flat point at the bottom of the arc and thus section **32*b* is slightly less curved than 32*a* and 32*c***. This flat point is created by the weight transference in the swing, e.g. weight moving away from the target and towards the target.

Swing template 32 is positioned flat on the ground until ball position faceplate 20. The fowardmost tip of portion **32*c* of template 32 is placed even with the forward end of line of flight guide 12 as shown in FIG. 2. Faceplate 20 is moved back along guide 12 for the driver, fairway woods, long irons etc. as described earlier. As faceplate 20 is moved back in the stance along the color-coded indicia 125 through 129, less and less of the swing template 32 is exposed along the backward club sweep path. The template 32, and its use as depicted in FIG. 2, shows the longer-to-shorter swing path for the sequence of longer-to-shorter clubs being practiced by the trainee. Note again that the template guide 32** is outside of the club hit area and yet provides visual and physical guidance for the trainee.

L. Turn

Turn in a golf swing is critical. It creates power by moving the big muscles of the body into the correct position. It allows the club to move to the correct "hit" position, so that the ball 11 is pinched between the clubhead and the ground.

In the training device 10 a pair of pole markers 50, 51 are placed alongside and slightly behind the stance line 16. Addressing the ball with both arms relatively straight, the trainee rotates the body towards the backswing marker 50, FIG. 1, keeping the arms relatively straight. As the club almost touches the marker 50, its position is correct and the backswing turn has occurred. The trainee then continues the movement to the forward swing marker 51, making sure to keep the arms relatively straight throughout the entire forward swing. The forward swing marker 51 is now in the proper location, and a proper forward turn has now occurred.

Once the vertical posts 50 and 51 are properly positioned in the manner just described, then the trainee can practice his backward and forward turns with the guides available as training references. In this practice area, as in all of the others eariler described, an improved swing will most likely be achieved by using the improved training device of this invention.

The above description presents the best mode contemplated in carrying out our invention. Our invention is, however, susceptible to modifications and alternate constructions from the embodiments shown in the drawings and described above. Consequently, it is not the intention to limit the invention to the particular embodiments disclosed. On the contrary, the invention is intended and shall cover all modifications, sizes and alternate constructions falling within the spirit and scope of the invention, as expressed in the appended claims when read in light of the description and drawing.

What is claimed is:

1. A portable lightweight golf training device adapted to be placed flat on the ground in front of a golf trainee with the device including means useful in aiding the trainee, in positioning his feet, the ball and the clubface of a selected club from fairway irons up through driver, to hit the type of desired golf shot being practiced; said device comprising:

three flat thin guide pieces (12, 13 and 16) with means (38, 46) for assembling the three guide pieces into essentially a lazy or reverse-U shape with a first line of stance guide (16) placed in front of the toes of the trainee and an unattached end pointing toward the target, and its other end adapted for attachment to a second guide, a second essentially perpendicular base guide (13) intersecting the other end of said first line of stance guide, and being to the right of a right-handed trainee and to the left of a left-handed trainee and a third line of flight guide (12) parallel to the line of stance guide and also having an unattached end pointing toward the target, and its other end adapted for essentially perpendicular attachment to said second base guide, with said three guides defining a partially enclosed space for receiving a clubhead alignment means and a ball location for a ball to be hit by said trainee with any of said selected clubs;

means (46) fastening said other end of the line of flight guide to one end of the base guide;

a first slide member (155, FIG. 5) slidably disposed on said base guide and having means (21, 22, 23) for being connected to said other end of said line of stance guide;

means (21, 22) fastening said other end of said line of stance guide to said first slide member;

similarly-spaced indicia (125–129, 125′–129′ and 131–136) on the upper surfaces of all three guides, with the indicia on the line of flight and line of stance guides being located on the ends thereof at the open part of said reverse-U assembly and the indicia on the perpendicular base guide being located on the end nearest to the trainee, with said indicia on said line of flight and line of stance guides being useful in locating the ball location and the indicia on said base guide being useful in allowing the user to select the spacing between the line of flight and line of stance guides to match the different requirements for any one of said several golf clubs selected to be used in practice by said trainee;

a second slide member (25) slidably disposed on said line of flight guide;

a third slide member (28) slidably disposed on said line of stance guide; and clubhead alignment means on at least one of said second and third slide members, with said clubhead alignment means having parallel lines (20, 26) on the upper surface thereof with said lines extending away from the line of flight and said line of stance guides and toward the ball location within said three guide pieces to assist the trainee in aligning parallel grooves on a clubhead with the parallel lines on said clubhead alignment means.

2. A training device in accordance with claim 1 and further comprising:

a slidable faceplate on said line of flight guide;

means in said line of flight faceplate for receiving an upstanding vertical post; and a horizontal sweep plate disposed on said vertical post and extending into said ball positioning space within said partial enclosure of said reverse-U to act as a guide for preventing a trainee from lifting a clubhead of a selected one of said clubs upon take away from said ball.

3. A training device in accordance with claim 1 and further comprising:

means slidable along said first line of flight guide for receiving an upstanding vertical post, which post acts as a head positioning guide for the user's head location.

4. A training device in accordance with claim 1 and further comprising:

a swing template (32) located essentially parallel to the line of flight guide and within said partial enclosure as an aid in visualizing for a trainee how the clubhead of the selected one of said clubs should move through the ball and said clubhead moves through the bottom of a golf swing with a selected one of said clubs.

5. A training device in accordance with claim 1 and further comprising;

a pair of upstanding posts one each of said posts positioned to the rear of the user and behind said stance guide to act as take-away and follow-through guides for controlling the trainee's body turn on a backswing, forward swing and follow-through.

6. A training device in accordance with claim 1 and further comprising:

a pair of upstanding posts each situated on or adjacent to said line of flight guide to assist a trainee in aligning his shoulders in a position parallel to the line of flight guide.

7. A portable lightweight golf swing training device adapted to be placed flat on the ground in front of a right or left-handed golf trainee for use in training with a club selected from a club set and excluding a putter, said device comprising:

three flat thin guide pieces with means for assembling the three guide pieces into essentialy a lazy, or reverse-U shape with a first line of stance guide placed in front of the toes of the trainee, a second perpendicular base guide being to the right of a right-handed trainee and to the left of a left-handed trainee and a third line of flight guide essentially parallel to the line of stance guide, said first and third guides having one end each unattached to any member and pointing toward the target, and the other ends thereof adapted to be closed by essentially perpendicular intersection at said second base guide, and with the three guide pieces defining a partially enclosed space for receiving a ball to be hit by a clubhead properly aligned behind the ball in said partially enclosed space;

means slidably fastening one end of the line of flight and line of stance guides to the base guide;

similarly-spaced color-coded indicia on the upper surfaces of all three guides to assist a trainee in swinging with different-numbered golf clubs designated by different color-coded indicia, with the indicia on the line of flight and line of stance guides being located on the ends thereof at the open part of said reverse-U assembly to aid a user in selecting his stance and a ball location and the color-coded indicia being located on said base guide at a position closer to said line of stance guide to aid a user in selecting his position away from said ball for a given one of said selected clubs;

a swing slide selectively positionable at said color-coded indicia on said line of flight guide to aid the user in locating a ball and a clubhead position;

a stance slide selectively positionable at said color-coded indicia to aid the user in locating his feet in a stance adjacent to and outside said line of stance guide;

at least one of said swing or stance slides, positioned on said line of flight and line of stance guides, being removeable or swivel-mounted, and including means for clubhead alignment, with said alignment means directed inwardly away from said line of flight and line of stance guides and toward said ball location; and means for permitting removal, or swivel, of at least one of said swing or stance slides, so that said base guide can be pivoted 180° degrees and said removed slide swiveled 180° degrees, or re-fastened, so that said base guide is to the left of a left-handed trainee whereby said single device accomodates practice by either a right-handed or left-handed trainee.

8. A portable lightweight golf swing training device adapted to be placed flat on the gound in front of a golf trainee, said device comprising:

three flat thin guide pieces with means for assembling the three guide pieces into essentially a reverse-U shape with a first line of stance guide placed in front of the toes of the trainee, a second perpendicular base guide being to the right of a right-handed trainee or to the left of a left-handed trainee and the third line of flight guide parallel to the line of stance guide, said three guides being arranged so that said first and third guides have an unattached end pointing toward a target and defining an open end of said reverse-U to provide an unimpeded follow-through of a full swing by said trainee while using any club of a clubhead other than a putter and the second guide intersecting the other ends of said first and third guides to form a closed end of said reverse-U shape;

a first slide member slidably disposed on said base guide and having means on the upper surface thereof for receiving one end of said line of stance guide;

means fastening one end of said line of stance guide to said first slide member;

a second slide member slidably disposed on said line of flight guide, a third slide member slidably disposed on said line of stance guide; and a pair of faceplates with one faceplate each on each of said second and third slide members and having parallel lines on the upper surfaces thereof with said lines extending away from the line of flight and line of stance guides toward a ball location within the reverse-U shape for assisting the trainee in aligning parallel grooves on a selected clubhead with the parallel lines on said pair of faceplates.

9. A portable light weight golf swing training device adapted to be placed flat on the ground in front of a golf trainee, said device comprising:

a plurality of similar flat thin guide pieces including a line of stance guide for placement in front of the toes of the trainee, a line of flight guide essentially parallel to the line of stance guide for placement slightly beyond a golf ball location for the trainee, and a base guide for placement to the right of a right-handed trainee and perpendicular to said line of stance and said line of flight guides to form essentially a reverse block U defined by said guide pieces, said U characterized by an open end toward a target and a closed end away from said target;

similarly-spaced indicia on the upper surfaces of all three guides to assist a trainee in swinging with different-numbered golf clubs designated by different indicia, said indicia being adjacent to the open end of said block U on said line of flight and line of stance guides and being towards the end of said base guide, which end is adjacently perpendicular to the line of stance guide and forms said closed end of said U;

means slidably fastening one end of the line of flight quide and one end of the line of stance guide to the base guide; and slidable fastening means for locking said guide pieces into essentially a rigid reverse block U configuration capable of movement on the gound in said locked configuration.

10. A training device in accordance with claim 9 and further comprising:

means for fixably connecting said locking and fastening means on said line of flight guide to an upper end of said base guide; and swivel means connecting said slidable fastening means on said base guide to said line of stance guide whereby said stance and base guides can be rotated 180° counterclockwise relative to said fixably-connected end of said line of flight guide to form a training device for a left-handed golf trainee.

* * * * *